US009429284B2

(12) United States Patent
Park et al.

(10) Patent No.: US 9,429,284 B2
(45) Date of Patent: Aug. 30, 2016

(54) ADJUSTABLE RECESSED TRIM

(75) Inventors: John S. Park, Fall River, MA (US); Clifford Russell Jones, Jr., Taunton, MA (US); Graham Michael Rippel, East Walpole, MA (US); Mark Owen Jones, South Dartmouth, MA (US)

(73) Assignee: Koninklijke Philips N.V., Eindhoven (NL)

( * ) Notice: Subject to any disclaimer, the term of this patent is extended or adjusted under 35 U.S.C. 154(b) by 1070 days.

(21) Appl. No.: 13/340,085

(22) Filed: Dec. 29, 2011

(65) Prior Publication Data

US 2013/0170232 A1 Jul. 4, 2013

(51) Int. Cl.

| | |
|---|---|
| ***F21S 8/02*** | (2006.01) |
| ***F21V 21/04*** | (2006.01) |
| ***F21V 21/30*** | (2006.01) |

(52) U.S. Cl.

CPC ..... *F21S 8/026* (2013.01); *F21V 21/04* (2013.01); *F21V 21/30* (2013.01)

(58) Field of Classification Search

USPC ..... 362/364, 145, 147, 148, 150

See application file for complete search history.

(56) References Cited

U.S. PATENT DOCUMENTS

| | | | | |
|---|---|---|---|---|
| 4,763,231 | A * | 8/1988 | Houplain | 362/148 |
| 5,268,824 | A * | 12/1993 | Czipri | 362/477 |
| 5,548,499 | A * | 8/1996 | Zadeh | 362/366 |
| 5,630,663 | A * | 5/1997 | Ling et al. | 362/365 |
| 6,948,831 | B1 * | 9/2005 | Naqvi | 362/276 |
| 7,484,866 | B1 * | 2/2009 | Buse | 362/366 |
| 7,559,677 | B1 * | 7/2009 | Dupre | 362/287 |
| 2009/0185359 | A1 * | 7/2009 | Martinez | 362/20 |

* cited by examiner

*Primary Examiner* — Stephen F Husar
*Assistant Examiner* — Danielle Allen

(57) ABSTRACT

An adjustable recessed trim for a lighting fixture includes an enclosure with a light output opening and a light source opening provided upward from the light output opening. An adjustable cover piece having a cover piece light source opening is provided over the enclosure in registration with the enclosure light source opening and is adjustable between at least a first position and a second position.

18 Claims, 6 Drawing Sheets

ADJUSTABLE RECESSED TRIM

TECHNICAL FIELD

The present invention is directed generally to adjustable recessed trim. More particularly, various inventive methods and apparatus disclosed herein relate to adjustable recessed trim for a lighting fixture.

BACKGROUND

Recessed lighting, where a lighting assembly is mounted in a recessed fashion in a ceiling or the like, is in common usage in the lighting industry. Typical recessed lighting fixture installations include a frame mounted inside a ceiling opposite the room side of the ceiling. The frame typically supports a junction box, includes hanger bars or other structure for securing the frame inside the ceiling, and also includes a frame aperture for receiving and supporting a trim or finishing section. After the frame has been installed, the trim or finishing section is then installed, typically from the room side of the ceiling through the opening in the ceiling and into the frame aperture. The trim or finishing section provides an aesthetically pleasing look from the room side of the ceiling and/or provides certain lighting characteristics.

In certain downlight implementations it may be desirable to have a light source whose positioning is adjustable. In such implementations a housing is typically provided inside the ceiling attached to the frame over the frame aperture. The light source is mounted within the housing and adjustably positioned so as to provide desired light output through the opening in the ceiling. The housing is larger than the frame aperture to enclose mechanical and/or electrical components that extend beyond the frame aperture. Although existing downlight implementations enable adjustability of the light source, they have one or more drawbacks. For example, the large housing over the frame may increase material costs of the downlight and/or may be difficult or impossible to install in certain environments (e.g., where plenum space is limited). Also, for example, the frame, housing, and/or other component of the downlight may not be adaptable for both adjustable and non-adjustable installations.

Thus, the Applicants have recognized a need in the art to provide an improved adjustable recessed downlight trim that optionally overcomes one or more disadvantages of existing adjustable downlights.

SUMMARY

The present disclosure is directed to inventive methods and apparatus for adjustable recessed trim. For example, in some embodiments an adjustable recessed trim for a lighting fixture is provided having an enclosure with a light output opening and a light source opening provided upward from the light output opening. An adjustable cover piece having a cover piece light source opening and a cover piece flange extending from the cover piece light source opening is provided over the enclosure and is adjustable between at least a first position and a second position. Methods related to the adjustable recessed trim are also provided. For example, methods related to installation, adjustment, and/or manufacture of the recessed trim are provided.

Generally, in one aspect, an adjustable recessed downlight trim is provided that includes a light output opening, an enclosure extending upwardly from the light output opening and defining an enclosed space therein, and an adjustable cover piece provided over the enclosure and adjustable between at least a first position and a second position. The enclosure has an enclosure light source opening therein provided upward from the light output opening. The cover piece has a cover piece light source opening and a cover piece flange extending from the cover piece light source opening. The cover piece light source opening is smaller than the enclosure light source opening and is in registration with the enclosure light source opening in the first position and the second position. The cover piece flange covers the remainder of the enclosure light source opening that is not in registration with the cover piece light source opening in the first position and in the second position.

In some embodiments the adjustable cover piece is pivotable between the first position and the second position. In some versions of those embodiments the adjustable cover piece is pivotally attached to the enclosure.

In some embodiments the cover piece is adjustable to a plurality of positions between the first position and the second position.

In some embodiments the first position and the second position are offset at least twenty degrees along an arcuate path.

In some embodiments the enclosure and the cover piece are in sliding contact with one another.

In some embodiments the cover piece flange has an arcuate cross section.

In some embodiments the enclosure and the adjustable cover piece are sized to extend through an adjustable recessed downlight frame in at least one of the first position and the second position.

In some embodiments the enclosure and the adjustable cover piece define a maximum peripheral dimension in the first position, and the maximum peripheral dimension is less than or equal to a peripheral dimension of a trim flange provided peripherally of the light output opening and below the enclosure.

In some embodiments the adjustable recessed downlight trim further includes a trim flange provided peripherally of the light output opening and below the enclosure. In some versions of those embodiments the enclosure and the adjustable cover piece do not extend peripherally beyond the trim flange in at least one of the first position and the second position.

In some embodiments the cover piece flange extends entirely around the cover piece light source opening.

Generally, in another aspect, an adjustable recessed trim is provided that includes a trim flange surrounding an opening, an enclosure extending upwardly from the trim flange and defining an enclosed space therein, and an adjustable cover piece pivotally coupled to the enclosure and adjustable along a substantially arcuate path between at least a first position and a second position. The enclosure has an upper enclosure opening therein provided upward from the opening. The cover piece has a cover piece opening and a cover piece flange extending from the cover piece opening. The cover piece opening is smaller than the upper enclosure opening and is in registration with the upper enclosure opening in the first position and the second position. The cover piece flange covers portions of the upper enclosure opening in the first position and the second position.

In some embodiments the enclosure includes a lower enclosure and an upper enclosure atop the lower enclosure. In some versions of those embodiments the trim flange is cohesively formed with the lower enclosure.

In some embodiments the cover piece includes a plurality of light source socket retention openings peripherally of the cover piece opening.

In some embodiments the enclosure and the adjustable cover piece do not extend beyond the trim flange in at least one of the first position and the second position.

Generally, in another aspect, a method of adjusting positioning of a light source opening in an adjustable recessed lighting fixture is provided and includes the step of slidably adjusting a positioning of an outer cover piece provided directly over top of a light source opening along an arcuate path, wherein the light source opening is provided in an upper portion of a trim frame enclosure substantially opposite a light output opening and the outer cover piece includes a cover piece opening therethrough that is smaller dimensionally than the light source opening.

In some embodiments the method further includes the step of fixing the positioning of the outer cover piece from an interior of the trim frame enclosure.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Although existing downlight implementations enable adjustability of the light source, they have one or more drawbacks. For example, the large housing utilized over the frame may increase material costs of the downlight and/or may limit installation options. Also, for example, the frame, housing, and/or other component of the downlight may not be adaptable for both adjustable and non-adjustable installations.

Thus, the Applicants have recognized a need in the art to provide an improved adjustable recessed downlight trim that optionally overcomes one or more disadvantages of existing adjustable downlights.

More generally, Applicants have recognized and appreciated that it would be beneficial to provide various inventive methods and apparatus related to adjustable recessed trim for a lighting fixture.

In view of the foregoing, various embodiments and implementations of the present invention are directed to adjustable recessed trim.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, aspects of the methods and apparatus disclosed herein are described in conjunction with and particularly suited for utilization in a lighting fixture. However, one or more aspects of the methods and apparatus described herein may be implemented in other configurations such as, for example, other recessed products such as cameras, speakers, and/or ventilation systems that may be installed in a recessed configuration.

An embodiment of an adjustable recessed downlight trim 10 is illustrated in FIGS. 1 through 6. The recessed downlight trim 10 is configured for implementation as a component of a recessed lighting fixture. The recessed downlight trim 10 can be installed within a frame aperture of a recessed lighting fixture installed within a ceiling or other recessed installation. As described herein, in some embodiments the recessed downlight trim 10 may be wholly installed from a room side of a recessed lighting fixture. Also, as described herein, in some embodiments the recessed downlight trim 10 may be installed as a component of a recessed lighting fixture and it will not be necessary to install a separate housing that is coupled to the recessed frame and provided over top of the recessed downlight trim 10.

Figure 1:
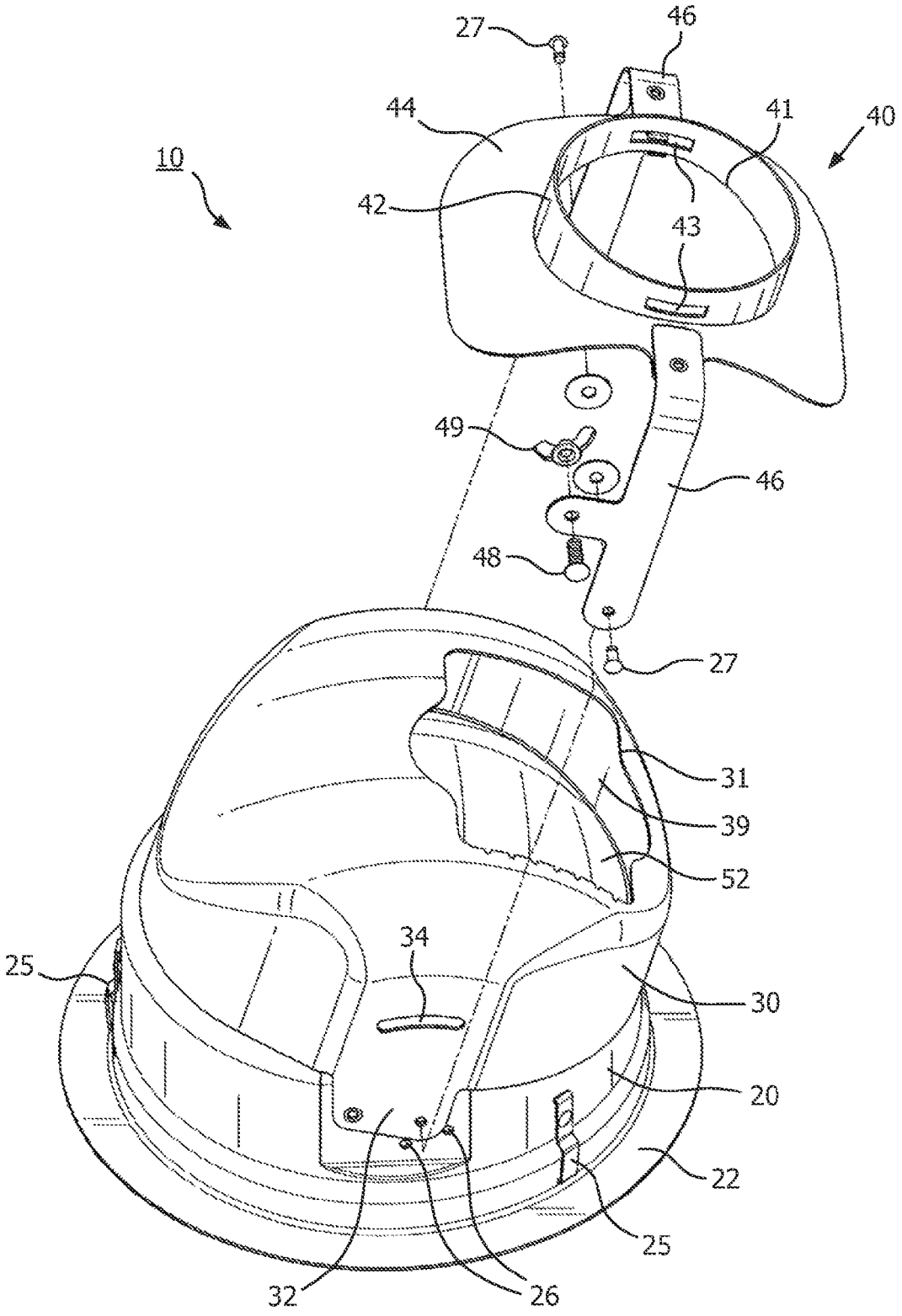
FIG. 1 illustrates a perspective view of an embodiment of an adjustable recessed downlight trim; a cover piece of the adjustable recessed downlight trim is illustrated exploded away.
Figure 2:
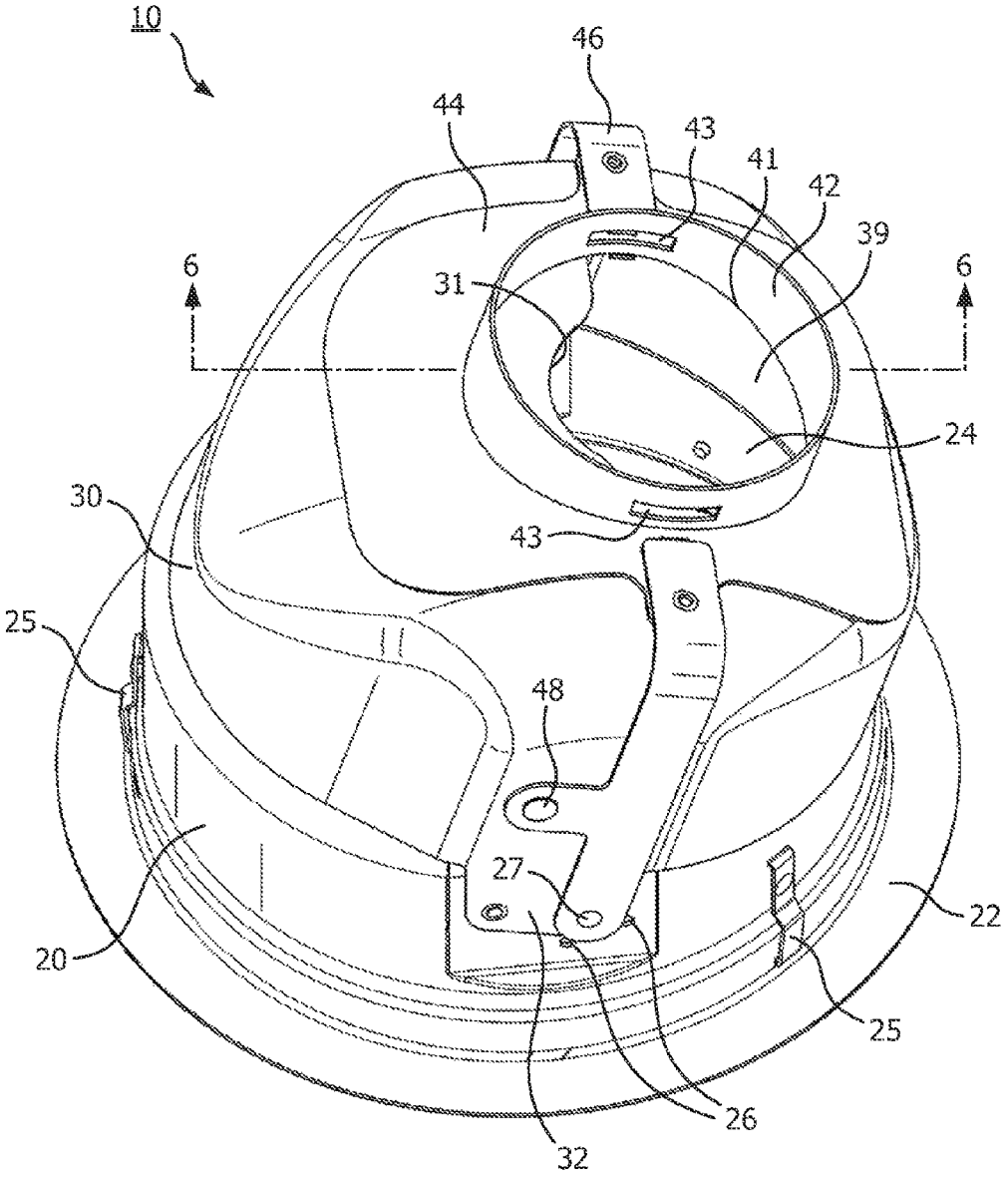
FIG. 2 illustrates an upper perspective view of the adjustable recessed downlight trim of FIG. 1 with the cover piece illustrated in a first position; an interior reflector cone is not shown.
Figure 3:
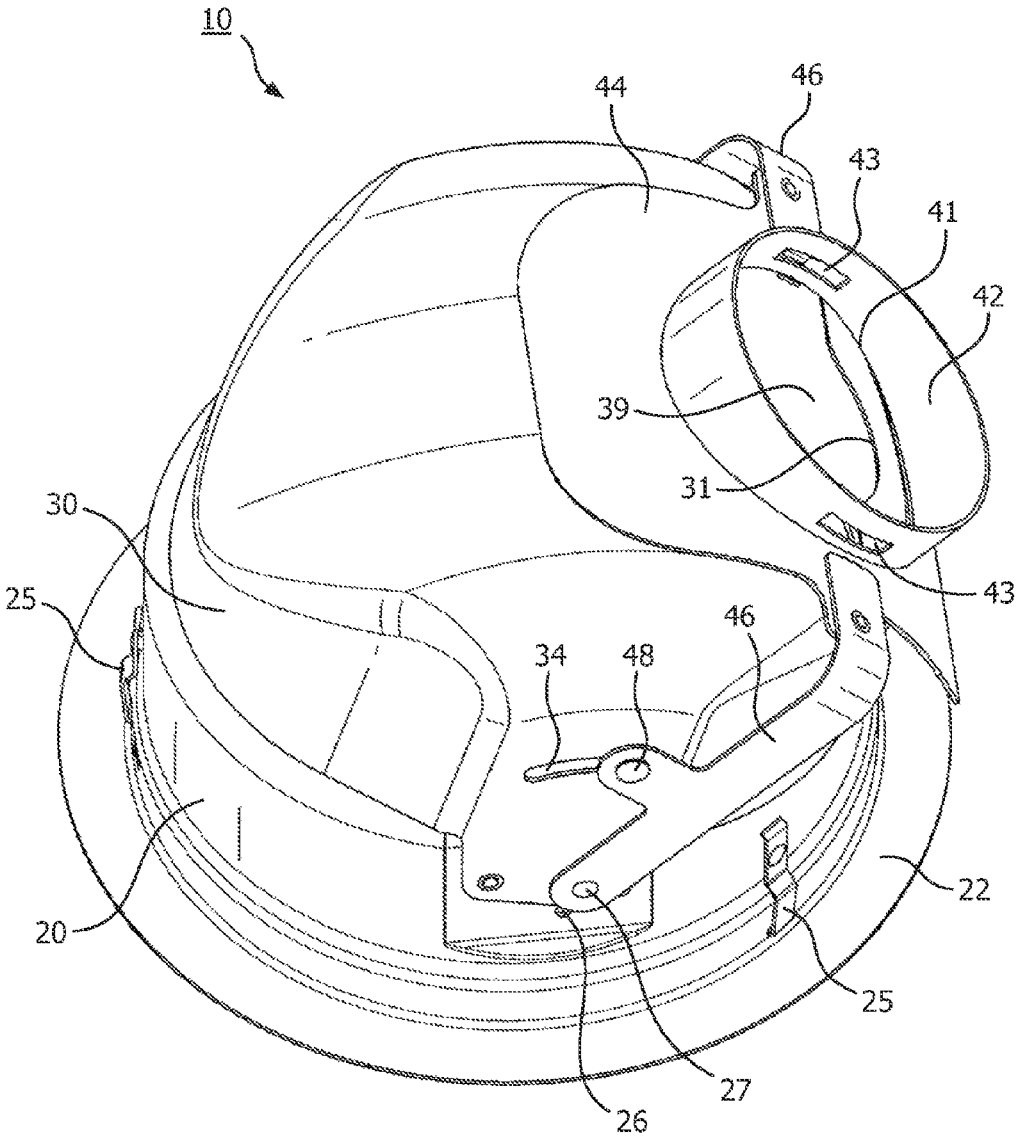
FIG. 3 illustrates an upper perspective view of the adjustable recessed downlight trim of FIG. 1 with the cover piece illustrated in a second position.

Referring initially to FIGS. 1-3, various upper perspective views of the recessed downlight trim 10 are illustrated. The recessed downlight trim 10 has an enclosure including a lower enclosure 20 and an upper enclosure 30. In alternative embodiments the enclosure may be formed of a single piece or more than two pieces. A cover piece 40 is pivotally coupled to the upper enclosure 30 and lower enclosure 20. In alternative embodiments the cover piece 40 may alternatively be coupled to only one of the lower enclosure 20 and the upper enclosure 30. The cover piece 40 is illustrated exploded away from the enclosure in FIG. 1. In FIG. 2 the cover piece 40 is illustrated in a first position and in FIG. 3 the cover piece 40 is illustrated adjusted to a second position.

The lower enclosure 20 includes a trim flange 22 extending radially from a lower extent thereof. When the recessed downlight trim 10 is installed in a recessed lighting fixture, the trim flange 22 will be provided on the room side of the ceiling covering the perimeter of the aperture that is provided through the ceiling for installation of the recessed lighting fixture. Retention springs 25 are provided upward of the trim flange 22 along a periphery of the lower enclosure 20. The retention springs 25 are biased to exert outward pressure on a frame aperture of a recessed lighting fixture to retain the recessed downlight trim 10 therein. Additional retention springs and/or other retention structure may optionally be provided along the periphery of the lower enclosure 20.

A connection extension 32 on each side of upper enclosure 30 extends down over the lower enclosure 20 and is attached thereto by rivets 27 that extend through openings of the connection extension 32 and through corresponding openings of the lower enclosure 20. The rivets 27 also extend through and connect a cover piece bracket 46 of the cover piece 40 and function as a pivot point of the cover piece 40. Additional openings 26 are visible through the lower enclosure 20 near the attachment of connection extension 32 thereto. The openings 26 provide for alternative attachment configurations of the upper enclosure 30 to the lower enclosure 20. For example, in the illustrated attachment configuration, a central axis of the light source opening 31 of the upper enclosure 30 is offset approximately fifteen degrees in a first direction from a central axis of the light output opening 21 of the lower enclosure 20. The central axis of the light source opening 31 is surrounded by the enclosure light source opening 31 of the upper enclosure 30 and extends through the center of the enclosure light source opening 31. The central axis of the light output opening 21 is surrounded by the light output opening 21 of lower enclosure 20 and extends centrally through the light output opening 21.

In alternative attachment configurations the upper enclosure 30 may be attached to one or more alternative openings 26 such as those that are visible to, for example, be offset in another direction, be fully aligned with the lower enclosure 20, and/or be offset to a differing degree relative to the lower enclosure 20. Multiple attachment configurations may enable the recessed downlight trim 10 to be utilized as an offset downlight and/or a direct downlight. Although a specific attachment configuration of the lower enclosure 20 to the upper enclosure 30 is illustrated, on of ordinary skill in the art, having had the benefit of the present disclosure, will recognize and appreciate that in alternative configurations other couplings may be utilized. For example, other fasteners may be utilized in addition to or as an alternative to rivets 27. Also, in some alternative embodiments the upper enclosure 30 and the lower enclosure 20 may be formed as one cohesive piece.

The upper enclosure 30 has an enclosure light source opening 31 extending therethrough. The enclosure light source opening 31 enables a light source and/or a socket for the light source to extend therethrough and be provided in the enclosed space of the enclosure. In the illustrated embodiment the enclosure light source opening 31 is substantially rectangular with two opposed arcuate notches formed in opposed sides of the light source opening 31. The enclosure light source opening 31 is provided at the top of the upper enclosure 30. In the illustrated embodiment a central axis of the light source opening 31 is offset approximately fifteen degrees in a first direction from a central axis of the light output opening 21. In alternative embodiments the central axis of the light source opening 31 may be offset to a differing degree and/or direction or may not be offset at all. The size of the enclosure light source opening 31 is larger than the lamp and/or lamp socket that will extend therethrough when the recessed downlight trim 10 is utilized in a recessed lighting fixture.

The cover piece 40 includes a cover piece opening 41 that is in registration with the enclosure light source opening 31 in the first position of FIG. 2 and in the second position of FIG. 3. The cover piece opening 41 has a rim 42 extending therearound that includes opposed openings 43. The rim 42 may receive and retain a light source socket therein. For example, a light source socket may include opposed biased protrusions that are aligned with the openings 43 and that may be retained within the openings 43 to thereby retain the light source socket. The cover piece opening 41 is sized to enable a light source socket, light source ballast, light source heatsink, and/or a light source to extend therethrough. In the illustrated embodiments the cover piece opening 41 is the same size as the opening formed by the rim 42. In alternative embodiments the rim 42 and the cover piece opening 41 may optionally be different sizes. As illustrated in FIGS. 2 and 3, portions of the cover piece opening 41 and the light source opening 31 are in registration with one another in the first and second positions. The portions in registration with one another are of a size to enable at least a portion of the light source to extend therethrough. A portion of the cover piece opening 41 is blocked by the upper enclosure 30 in the first position and second position in the illustrated embodiment. In other adjustment positions of the cover piece 40 the cover piece opening 41 may be blocked to a lesser extent or not at all by the upper enclosure 30. For example, in a position approximately midway between the first position and the second position the cover piece opening 41 and the light source opening 31 may be in complete non-blocked registration with one another.

Figure 6:
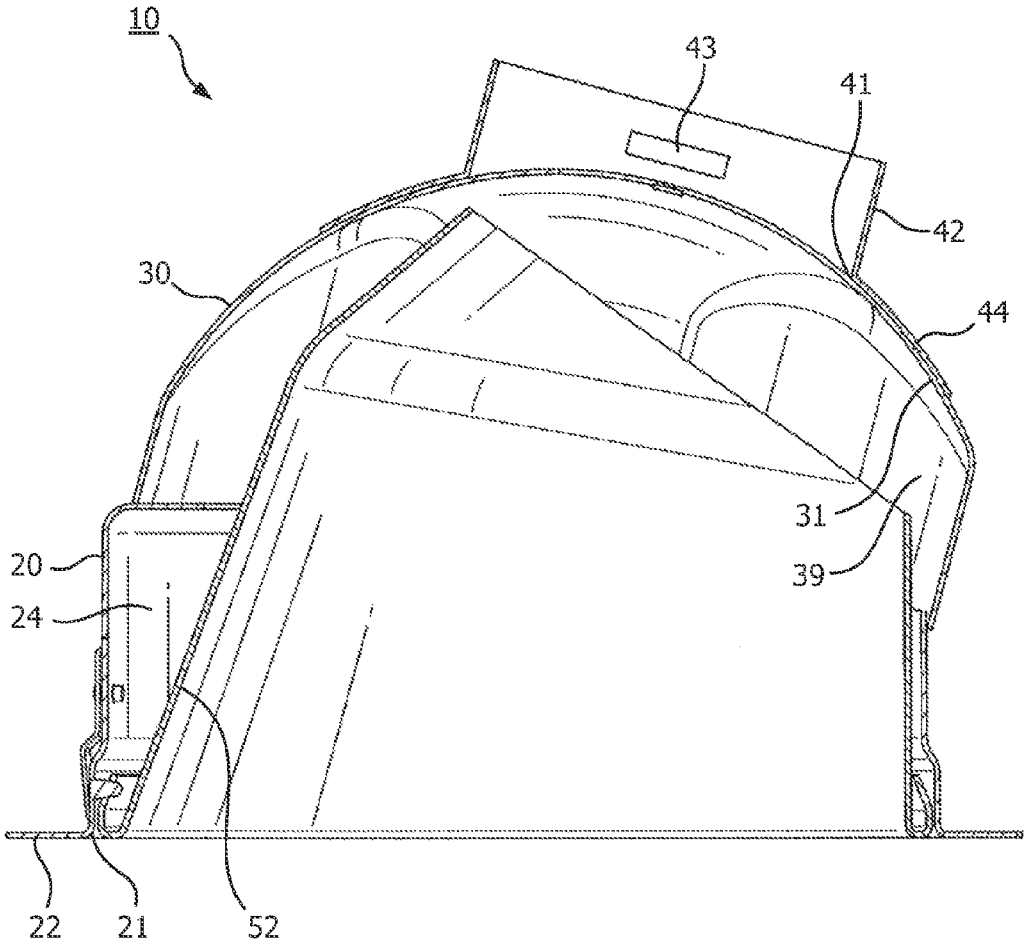
FIG. 6 illustrates a section view of the adjustable recessed downlight trim taken along the section line 6-6 of FIG. 2.

Provided peripherally of the cover piece opening 41 and rim 42 is a cover piece flange 44 that sits atop the upper enclosure 30. The cover piece flange 44 may optionally be in sliding engagement with the upper enclosure 30. The illustrated cover piece flange 44 has a substantially arcuate lower surface that substantially matches the shape of portions of the upper surface of the upper enclosure 30. For example, as illustrated in FIG. 2 and FIG. 6, the cover piece flange 44 is directly atop the upper enclosure 30 in the first position. In the second position of FIG. 3, the cover piece flange 44 is directly atop the upper enclosure 30 and a portion of the cover piece flange 44 overhangs the upper enclosure 30. In all positions of the cover piece 40, portions of the light source opening 31 are covered by the cover piece flange 44 to thereby restrict the effective size of the opening 31 between the enclosed space and the ceiling side of the recessed downlight trim 10.

Extending downward from each side of the cover piece 40 is one cover piece bracket 46. The cover piece brackets 46 are coupled to the upper enclosure 30 and lower enclosure 20 at a pivot point by rivet 27. One cover piece bracket 46 also includes an extension with a screw 48 extending therethrough. The screw 48 extends through an arcuate slot 34 provided through upper enclosure 30. The screw 48 moves within slot 34 to guide cover piece 40 along a path during adjustment. The length of slot 34 may be selected to restrict movement of the cover piece 40 to a desired range of motion. For example, in the illustrated embodiment the slot 34 extends approximately thirty degrees around a center point thereof and restricts movement of the cover piece 40 to positions between the first position of FIG. 2 and second position of FIG. 3.

Although a specific attachment of cover piece 40 to the enclosure is illustrated and described herein, one of ordinary skill in the art, having had the benefit of the present disclosure, will recognize and appreciate that in alternative embodiments other configurations may be utilized. For example, in some embodiments protrusions may additionally or alternatively be provided on each side of one or both of the cover piece brackets 46 that contact the cover piece brackets 46 in the first position and the second position and restrict movement of the cover piece 40 between the first position and second position. Also, for example, in some embodiments, in addition to or as an alternative to the cover piece brackets 46, the cover piece flange 44 may ride in and be retained in tracks extending from the upper enclosure 30 around all or portions of the cover piece 40.

Although a circular trim flange 22 and substantially circular enclosure are illustrated and described herein, one of ordinary skill in the art, having had the benefit of the present disclosure, will recognize and appreciate that in alternative embodiments the trim flange 22 and/or enclosure may take on other shapes. For example, the trim flange 22 may be generally elliptical, rectangular, or other shape in some alternative embodiments. Also, for example, in some alternative embodiments the enclosure may optionally be modified to substantially correspond to the shape of the trim flange 22.

Figure 4:
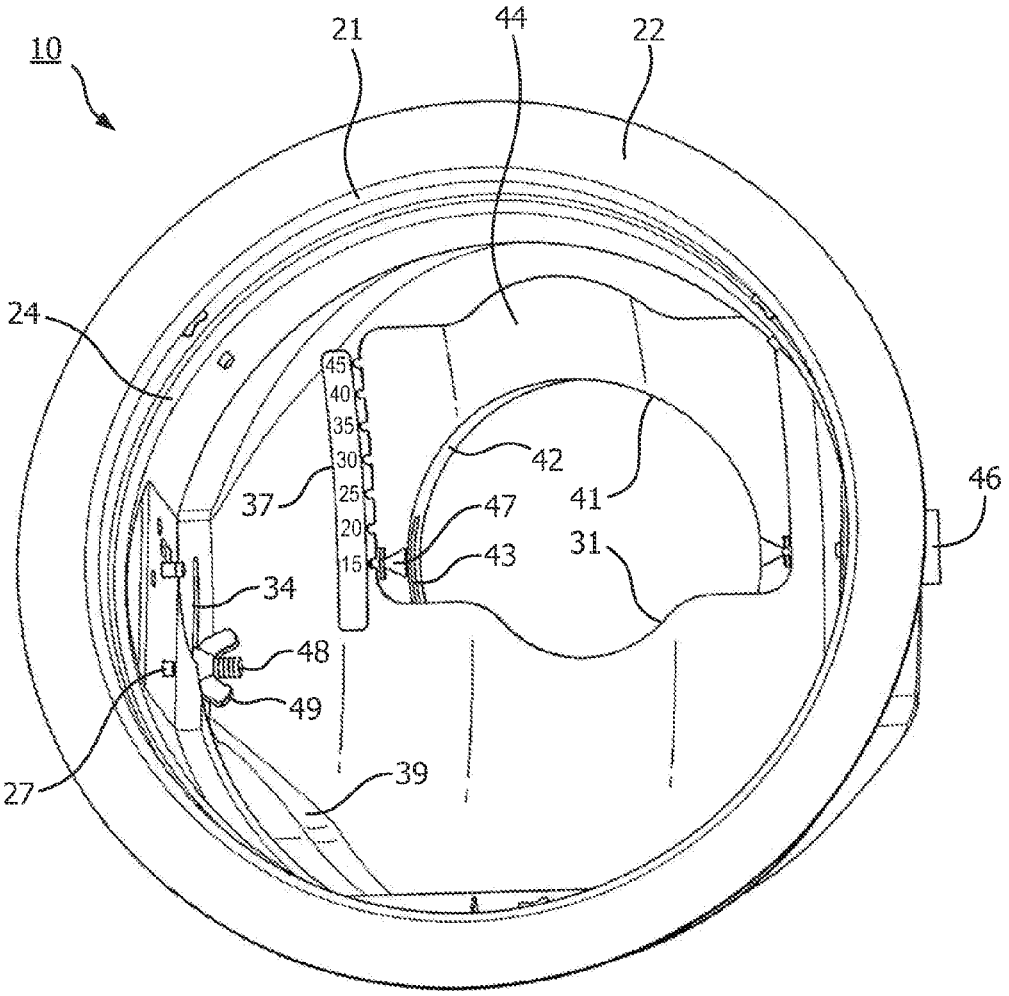
FIG. 4 illustrates a lower perspective view of the adjustable recessed downlight trim of FIG. 1 with the cover piece illustrated in the first position; the interior reflector cone is not shown.
Figure 5:
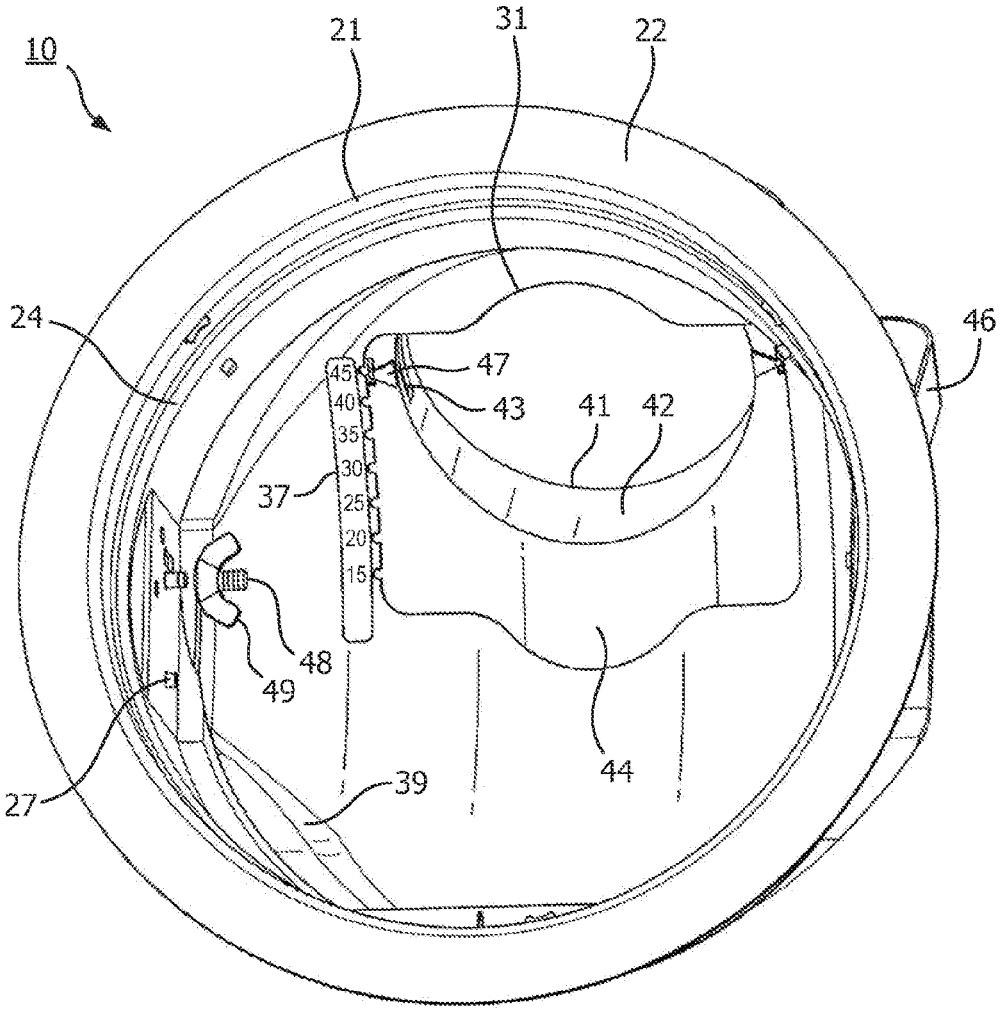
FIG. 5 illustrates a lower perspective view of the adjustable recessed downlight trim of FIG. 1 with the cover piece illustrated in the second position; the interior reflector cone is not shown.

Referring to FIGS. 4-6, additional views of the recessed downlight trim 10 are illustrated. FIGS. 4 and 5 illustrate various lower perspective views of the recessed downlight trim 10 and FIG. 6 provides a section view of the recessed downlight trim 10 along the section line 6-6 of FIG. 2. In FIG. 4 the cover piece 40 is illustrated in the first position and in FIG. 5 the cover piece 40 is illustrated adjusted to the second position. Interior surface 24 of lower enclosure 20 is visible in FIGS. 2, 4, and 5 and may optionally be configured to provide desired aesthetic and/or light altering characteristics. Interior surface 39 of upper enclosure 30 is also visible and may similarly optionally be configured to provide desired aesthetic and/or light altering characteristics. In FIGS. 1 and 6 an interior reflector cone 52 is visible provided interior of the enclosure and blocking the interior surface 24 and portions of the interior surface 39. The interior reflector cone 52 is not illustrated in FIGS. 2, 4, and 5 for ease in viewing other aspect of the recessed downlight trim 10. The interior reflector cone 52 may provide desired light output characteristics for the recessed downlight trim 10. In other embodiments one or more additional or alternative reflectors such as a kick reflector and/or a parabolic reflector may be provided. Also, for example, one or more light blocking structures may be provided such as a light blocking structure partially covering the light output opening 21. Such alternative and/or additional structure may optionally be provided as a separate component interior of the enclosure (such as interior reflector cone 52) and/or may be cohesively formed as part of the enclosure.

A wing nut 49 is attached to screw 48 and may be tightened by a user to fix the positioning of the cover piece 40 at a desired location. For example, the user may tighten the wing nut 49 when the cover piece 40 is at a position between the first and second positions to fix the cover piece at such position. Angle indicator markings 37 may optionally be provided on the interior surface 39 in combination with an angle indicator 47 on the interior facing portion of the cover piece 40. The markings 37 and indicator 47 provide a user with an indication of the selected adjustment angle of the light source.

As illustrated in FIGS. 2 and 6, in the first position the enclosure and the cover piece 40 do not extend beyond the trim piece flange 22. Also, in the first position, the cover piece 40 and the enclosure define a maximum peripheral dimension upward of the trim flange 22 that is sized to fit through a frame aperture of a recessed lighting fixture. Thus, the recessed downlight trim 10 may optionally be installed from a room side of the fixture through a frame aperture. The maximum peripheral dimension in the first position may also be less than or equal to a peripheral dimension of the light output opening 21. The recessed downlight trim 10 may be installed as a component of a recessed lighting fixture and it will not be necessary to install a separate housing that is coupled to the recessed frame and provided over top of the recessed downlight trim 10. In some embodiments the light source opening 31 alone may be larger than a maximum size that is allowed for UL or other certification. However, the covering of the light source opening 31 with the cover piece 40 and the resulting opening provided by virtue of at least portions light source opening 31 and cover piece opening 41 being in registration with one another provide an effective opening that is of a size sufficiently small for UL or other certification.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An adjustable recessed downlight trim, comprising:

a light output opening;

an enclosure extending upwardly from said light output opening and defining an enclosed space therein, said enclosure having an enclosure light source opening therein provided upward from said light output opening;

an adjustable cover piece provided over said enclosure and adjustable between at least a first position and a second position by a sliding movement across an enclosure surface of the enclosure, said cover piece having a cover piece light source opening and a cover piece flange extending from said cover piece light source opening, wherein any light visible through said light output opening is light that has first passed through said cover piece light source opening;

wherein said cover piece light source opening is smaller than said enclosure light source opening and is in registration with said enclosure light source opening in said first position and said second position; and wherein said cover piece flange covers the remainder of said enclosure light source opening not in registration with said cover piece light source opening in said first position and in said second position.

2. The adjustable recessed downlight trim of claim 1, wherein said adjustable cover piece is pivotable between said first position and said second position.

3. The adjustable recessed downlight trim of claim 2, wherein said adjustable cover piece is pivotally attached to said enclosure.

4. The adjustable recessed downlight trim of claim 1, wherein said cover piece is adjustable to a plurality of positions between said first position and said second position.

5. The adjustable recessed downlight trim of claim 1, wherein said first position and said second position are offset at least twenty degrees along an arcuate path.

6. The adjustable recessed downlight trim of claim 1, wherein said enclosure and said adjustable cover piece are in sliding contact with one another.

7. The adjustable recessed downlight trim of claim 1, wherein said cover piece flange has an arcuate cross section.

8. The adjustable recessed downlight trim of claim 1, wherein said enclosure and said adjustable cover piece are sized to extend through an adjustable recessed downlight frame in at least one of said first position and said second position.

9. The adjustable recessed downlight trim of claim 1, wherein said enclosure and said adjustable cover piece define a maximum peripheral dimension in said first position, and wherein said maximum peripheral dimension is less than or equal to a peripheral dimension of a trim flange provided peripherally of said light output opening and below said enclosure.

10. The adjustable recessed downlight trim of claim 1, further comprising a trim flange provided peripherally of said light output opening and below said enclosure.

11. The adjustable recessed downlight trim of claim 10, wherein said enclosure and said adjustable cover piece do not extend peripherally beyond said trim flange in at least one of said first position and said second position.

12. The adjustable recessed downlight trim of claim 1, wherein said cover piece flange extends entirely around said cover piece light source opening.

13. An adjustable recessed trim, comprising:

a trim flange surrounding a light output opening;

an enclosure extending upwardly from said trim flange and defining an enclosed space therein, said enclosure having an upper enclosure opening therein provided upward from said opening;

an adjustable cover piece pivotally coupled to said enclosure and adjustable along a substantially arcuate path between at least a first position and a second position by a sliding movement across an enclosure surface of the enclosure, said cover piece having a cover piece light source opening and a cover piece flange extending from said cover piece light source opening, wherein any light visible through said light output opening is light that has first passed through said cover piece light source opening;

wherein said cover piece opening is smaller than said upper enclosure opening and is in registration with said upper enclosure opening in said first position and said second position; and wherein said cover piece flange covers portions of said upper enclosure opening in said first position and said second position.

14. The adjustable recessed trim of claim 13, wherein said enclosure includes a lower enclosure and an upper enclosure atop said lower enclosure.

15. The adjustable recessed trim of claim 14, wherein said trim flange is cohesively formed with said lower enclosure.

16. The adjustable recessed trim of claim 13, wherein said adjustable cover piece includes a plurality of light source socket retention openings peripherally of said cover piece opening.

17. The adjustable recessed trim of claim 13, wherein said enclosure and said adjustable cover piece do not extend beyond said trim flange in at least one of said first position and said second position.

18. The adjustable recessed downlight trim of claim 1, wherein the cover piece flange has a flange surface that corresponds to the surface of the enclosure for the sliding movement of the flange surface relative the enclosure surface.

* * * * *